US011415365B2

(12) United States Patent
Kim et al.

(10) Patent No.: US 11,415,365 B2
(45) Date of Patent: Aug. 16, 2022

(54) SHELF BRACKET AND REFRIGERATOR HAVING THE SAME

(71) Applicant: SAMSUNG ELECTRONICS CO., LTD., Suwon-si (KR)

(72) Inventors: Joong Ho Kim, Gwangju (KR); Kwang-Hyuk Cha, Gwangju (KR); Je Hun Kang, Gwangju (KR); Sung-Cheul Park, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 258 days.

(21) Appl. No.: 16/643,729

(22) PCT Filed: Aug. 28, 2018

(86) PCT No.: PCT/KR2018/009894
§ 371 (c)(1),
(2) Date: Mar. 2, 2020

(87) PCT Pub. No.: WO2019/045403
PCT Pub. Date: Mar. 7, 2019

(65) Prior Publication Data

US 2020/0400369 A1 Dec. 24, 2020

(30) Foreign Application Priority Data

Aug. 29, 2017 (KR) ..... 10-2017-0109525

(51) Int. Cl.
*F25D 25/02* (2006.01)
*A47B 57/14* (2006.01)
(Continued)

(52) U.S. Cl.
CPC ..... *F25D 25/02* (2013.01); *A47B 57/14* (2013.01); *A47B 57/42* (2013.01); *A47B 57/56* (2013.01);
(Continued)

(58) Field of Classification Search
CPC ..... F25D 25/02; A47B 96/061; A47B 57/20; A47B 57/16; A47B 57/40; A47B 57/48; A47B 57/482; A47B 57/425; A47B 57/42
See application file for complete search history.

(56) References Cited

U.S. PATENT DOCUMENTS 723,677 A 3/1903 Kade
977,609 A 12/1910 Freeman
(Continued)

FOREIGN PATENT DOCUMENTS

CN 1677027 A 10/2005
DE 20215552 U1 * 2/2003 ..... A47B 96/061
(Continued)

OTHER PUBLICATIONS

Extended European Search Report dated Jul. 10, 2020, in corresponding European Patent Application No. 18849570.9.
(Continued)

*Primary Examiner* — Andrew M Roersma
(74) *Attorney, Agent, or Firm* — Staas & Halsey LLP

(57) ABSTRACT

The present disclosure relates to a shelf bracket and a refrigerator having the same. The shelf bracket includes a seating portion on which a shelf is seated, a mounting portion provided at a rear side of the seating portion, and a reinforcing portion integrally extending from the shelf bracket and folded to overlap at least one of the seating portion and the mounting portion, so that the strength of the shelf bracket is reinforced by the reinforcing portion.

8 Claims, 7 Drawing Sheets

(51) Int. Cl.

| | |
|---|---|
| ***A47B 57/42*** | (2006.01) |
| ***A47B 57/56*** | (2006.01) |
| ***A47B 96/06*** | (2006.01) |

(52) U.S. Cl.
CPC ..... *A47B 96/061* (2013.01); *F25D 2325/021* (2013.01)

(56) References Cited

U.S. PATENT DOCUMENTS

| | | | | | |
|---|---|---|---|---|---|
| 2,103,106 | A * | 12/1937 | Rkovitch | A47B 57/42 | 248/223.41 |
| 2,653,783 | A * | 9/1953 | Lindsay | A47B 57/42 | 248/243 |
| 2,845,187 | A | 7/1958 | Bianchi | | |
| 3,041,033 | A * | 6/1962 | Schwartz | A47B 96/061 | 248/248 |
| 3,115,972 | A * | 12/1963 | Schild | A47B 96/061 | 211/149 |
| 5,318,264 | A | 6/1994 | Meiste | | |
| 2004/0149182 | A1 | 8/2004 | Bienick et al. | | |
| 2005/0217305 | A1* | 10/2005 | Park | A47B 57/42 | 62/389 |
| 2007/0221597 | A1 | 9/2007 | Chen | | |
| 2017/0280875 | A1* | 10/2017 | Buckley | A47B 47/021 | |

FOREIGN PATENT DOCUMENTS

| | | | | | |
|---|---|---|---|---|---|
| DE | 102007013900 | A1 * | 9/2008 | A47B 57/42 | |
| EP | 1854375 | A1 * | 11/2007 | A47B 96/1441 | |
| FR | 700113 | A * | 2/1931 | C10B 31/02 | |
| FR | 2 415 441 | | 8/1979 | | |
| GB | 1361087 | A * | 7/1974 | A47B 57/42 | |
| JP | 2013-111319 | | 6/2013 | | |
| KR | 10-2005-0009812 | | 1/2005 | | |
| KR | 10-2005-0096344 | | 10/2005 | | |
| KR | 10-2005-0096344 | A | 10/2005 | | |
| KR | 10-2014-0131758 | | 11/2014 | | |
| KR | 10-2014-0134865 | | 11/2014 | | |
| KR | 10-2015-0105868 | | 9/2015 | | |
| WO | WO-2011083214 | A1 * | 7/2011 | A47B 97/00 | |
| WO | WO-2018115754 | A1 * | 6/2018 | A47B 57/40 | |

OTHER PUBLICATIONS

Chinese Office Action dated Sep. 14, 2021, in Chinese Application No. 201880056628.X.
Korean Office Action dated Nov. 22, 2021, in Korean Application No. 10-2017-0109525.
Chinese Office Action dated Mar. 29, 2021, in corresponding Chinese Patent Application No. 201880056628.X.
Office Action dated Jan. 10, 2022, in Chinese Application No. 201880056628.X.
Office Action dated May 20, 2022, issued in Korean Application No. 10-2017-0109525.

* cited by examiner

SHELF BRACKET AND REFRIGERATOR HAVING THE SAME

CROSS-REFERENCE TO RELATED APPLICATIONS

This application is a U.S. National Stage Application which claims the benefit under 35 U.S.C. § 371 of International Patent Application No. PCT/KR2018/009894 filed on Aug. 28, 2018, which claims foreign priority benefit under 35 U.S.C. § 119 of Korean Patent Application No. 10-2017-0109525 filed on Aug. 29, 2017, in the Korean Intellectual Property Office, the contents of all of which are incorporated herein by reference.

TECHNICAL FIELD

The present disclosure relates to a shelf bracket for supporting a shelf and a refrigerator having the same.

BACKGROUND ART

In general, a refrigerator includes components of a refrigeration cycle therein and may keep foods stored in a storage chamber in a freezing mode or a refrigeration mode by supplying cold air generated from an evaporator of the refrigeration cycle to the storage chamber.

In the refrigerator, a shelf for dividing the storage chamber up and down is disposed in the storage chamber such that contents may be stored separately through the shelf.

A shelf bracket is installed in the storage chamber to install the shelf. The shelf bracket is formed in a cantilever shape extending in the front-rear direction, a rear end of which is mounted to a rear surface of the storage chamber.

Two of the shelf brackets are provided for each shelf such that opposite side ends of the shelf are supported by the respective shelf brackets.

DISCLOSURE

Technical Problem

The present disclosure is directed to providing a refrigerator including a shelf bracket of significantly high strength.

Technical Solution

One aspect of the present disclosure provides a refrigerator including a main body provided in which a storage chamber is provided, a shelf configured to partition the storage chamber in the up-down direction, and a shelf bracket configured to support the shelf, wherein the shelf bracket includes a seating portion on which the shelf is seated, a mounting portion mounted to the storage chamber, and a reinforcing portion integrally extending from the shelf bracket and folded to overlap at least one of the seating portion and the mounting portion.

The reinforcing portion may integrally extend from a rear end of the mounting portion and may be folded to overlap the mounting portion.

The mounting portion may include a hooking portion protruding downward from a rear upper portion thereof, and the reinforcing portion may include a hooking reinforcing portion formed in a shape symmetrical with the hooking portion about the rear end of the mounting portion as a center line.

The mounting portion may include an insertion portion protruding rearward from a rear lower portion thereof, and the reinforcing portion may include an insertion reinforcing portion formed in a shape symmetrical with the insertion portion about the rear end of the mounting portion as the center line.

The refrigerator may further include a coupling protrusion provided on one of the mounting portion and the reinforcing portion, and a coupling hole provided on the other of the mounting portion and the reinforcing portion to allow the coupling protrusion to be coupled.

The reinforcing portion may integrally extend from an upper end of the seating portion and may be folded to overlap the seating portion and the mounting portion.

The refrigerator may further include a coupling protrusion provided on one of the seating portion, the mounting portion, and the reinforcing portion, and a coupling hole provided on the other of the seating portion, the mounting portion, and the reinforcing portion to allow the coupling protrusion to be coupled.

A pair of the shelf brackets may be disposed to be spaced apart from each other to correspond to opposite side ends of the shelf.

The refrigerator may further include a shelf mounting guide extending in the up-down direction, wherein the shelf mounting guide may include a plurality of mounting holes formed the up-down direction.

Another aspect of the present disclosure provides a shelf bracket including a seating portion on which a shelf is seated, a mounting portion provided at a rear side of the seating portion, and a reinforcing portion integrally extending from a rear end of the mounting portion and folded to overlap the mounting portion.

Another aspect of the present disclosure provides a shelf bracket including a seating portion on which a shelf is seated, a mounting portion provided at a rear side of the seating portion, and a reinforcing portion integrally extending from an upper end of the seating portion and folded to overlap the seating portion and the mounting portion.

Advantageous Effects

In a shelf bracket and a refrigerator according to one aspect of the present disclosure, because a reinforcing portion integrally extending from the shelf bracket is folded to overlap at least one of a seating portion and a mounting portion, the strength of the shelf bracket is reinforced by the reinforcing portion.

MODE OF THE INVENTION

The embodiments described herein and the configurations shown the drawings are only examples of preferred embodiments of the present disclosure, and various modifications may be made at the time of filing of the present disclosure to replace the embodiments and drawings of the specification.

Like reference numbers or signs in the various figures of the present application represent parts or components that perform substantially the same functions.

The terms used herein are for the purpose of describing the embodiments and are not intended to limit the present disclosure. For example, the singular expressions herein may include plural expressions, unless the context clearly dictates otherwise. The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 1:
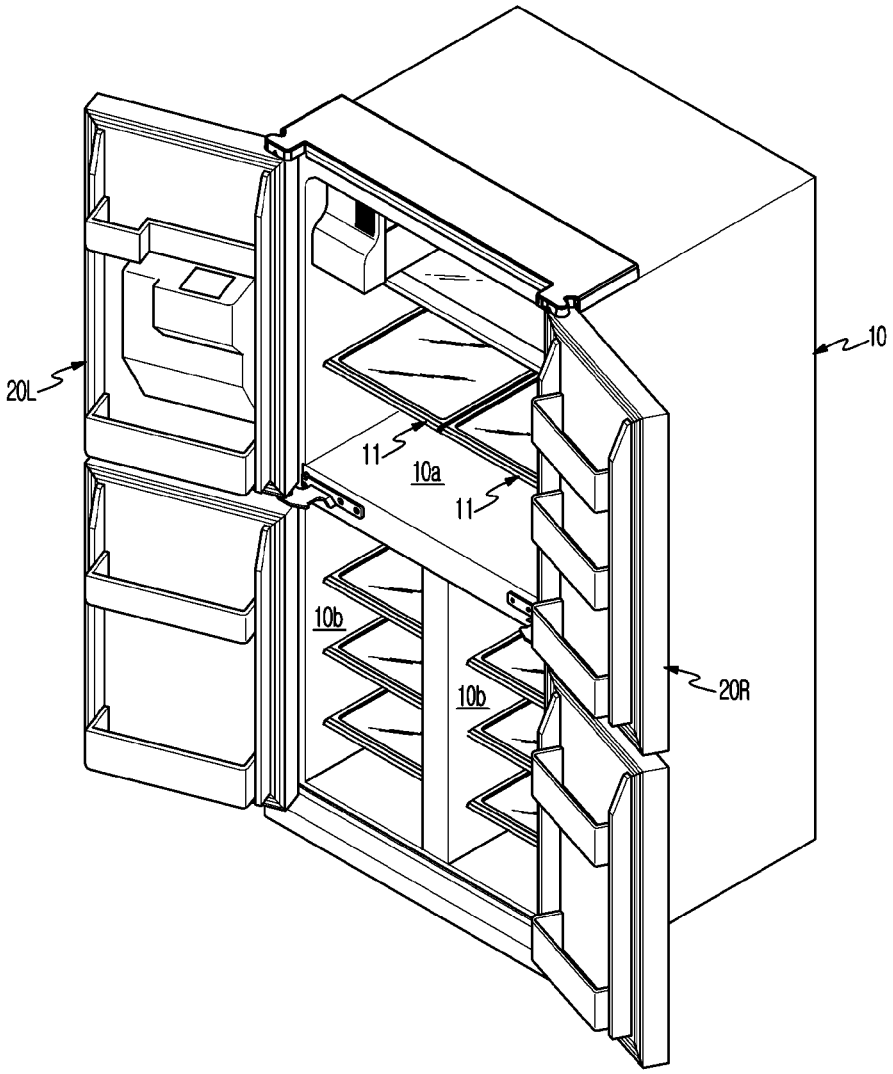
FIG. 1 is a perspective view of a refrigerator according to the present disclosure.

As illustrated in FIG. 1, a refrigerator according to an embodiment of the present disclosure includes a main body 10 in which storage chambers 10*a* and 10*b* are provided, and a pair of doors 20L and 20R rotatably installed on a front surface of the main body 10 to open and close the storage chambers 10*a* and 10*b*.

In addition, although not shown in the drawings, the refrigerator includes components of a refrigeration cycle such as a compressor, a condenser, an evaporator, and an expansion valve such that cool air generated from the evaporator is supplied to the storage chambers.

The storage chambers 10*a* and 10*b* are partitioned up and down to form the refrigerating chamber 10*a* at an upper side and the freezing chamber 10*b* at a lower side.

Figure 2:
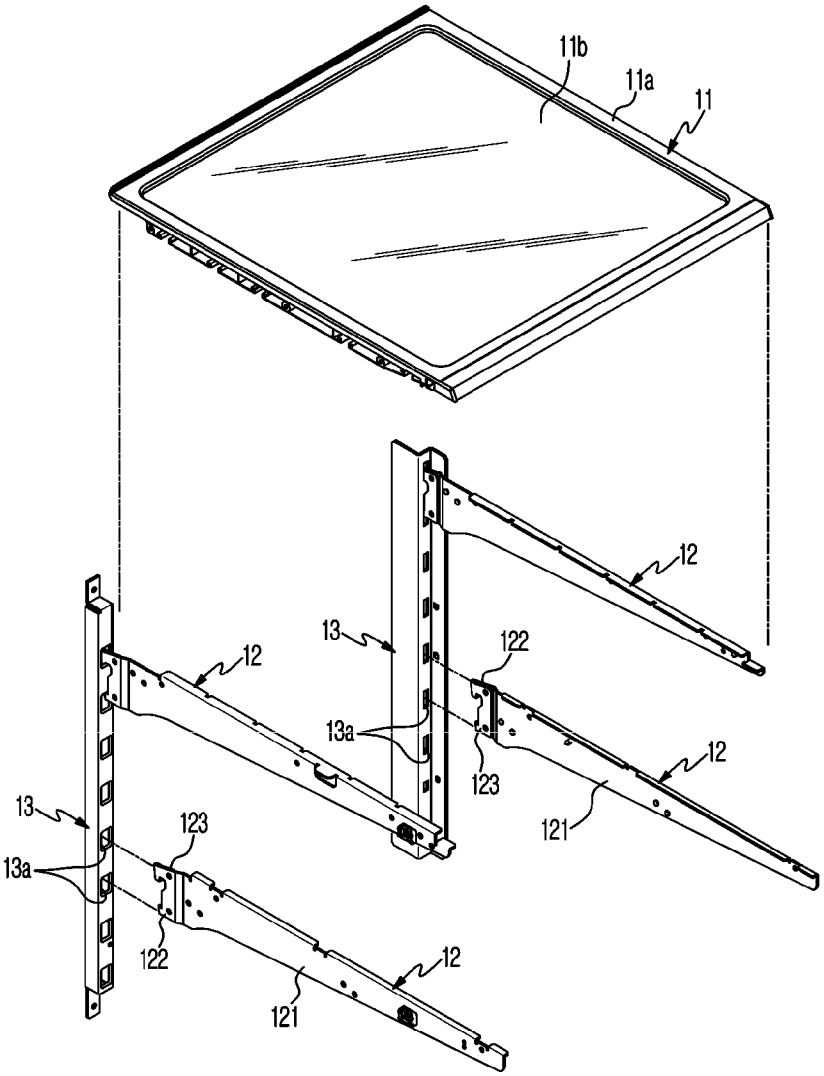
FIG. 2 is a perspective view of a shelf and shelf bracket applied to a refrigerator according to a first embodiment of the present disclosure.

As illustrated in FIG. 2, the refrigerator also includes shelves 11 configured to partition the refrigerating chamber 10*a* and the freezing chamber 10*b* up and down to separately store various foods, shelf brackets 12 formed in a cantilever shape and installed to rear surfaces of the storage chambers 10*a* and 10*b* to support the shelves 11, and shelf mounting guides 13 to which rear ends of the shelf brackets 12 are mounted.

The shelf 11 is formed in a substantially rectangular flat plate shape and is arranged horizontally such that food is placed on an upper surface thereof. The shelf 11 includes a rectangular ring-shaped frame 11*a*, and a rectangular glass plate 11*b* formed of a transparent or translucent material and installed in the frame 11*a*.

Figure 3:
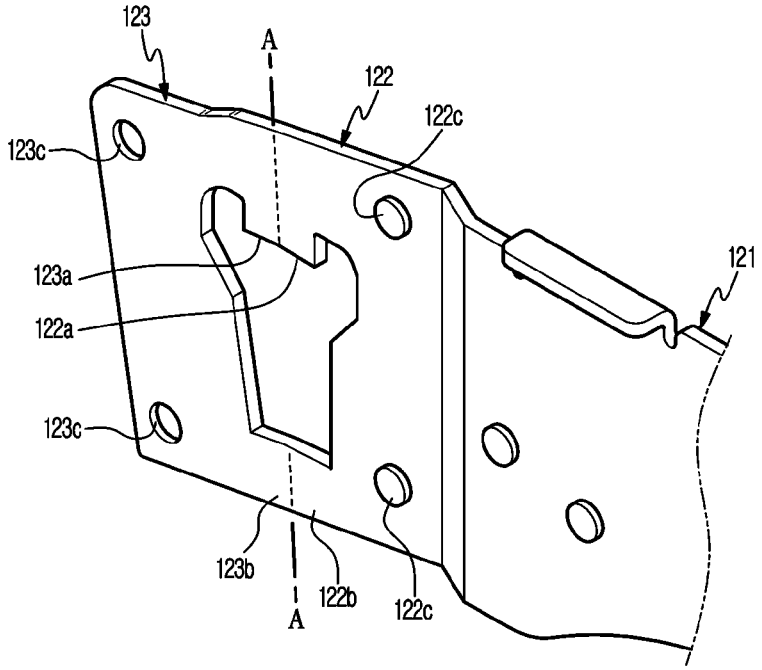
FIG. 3 is a perspective view of a mounting portion and a reinforcing portion of the shelf bracket applied to a refrigerator according to the first embodiment of the present disclosure, showing a state before the reinforcing portion is folded.
Figure 4:
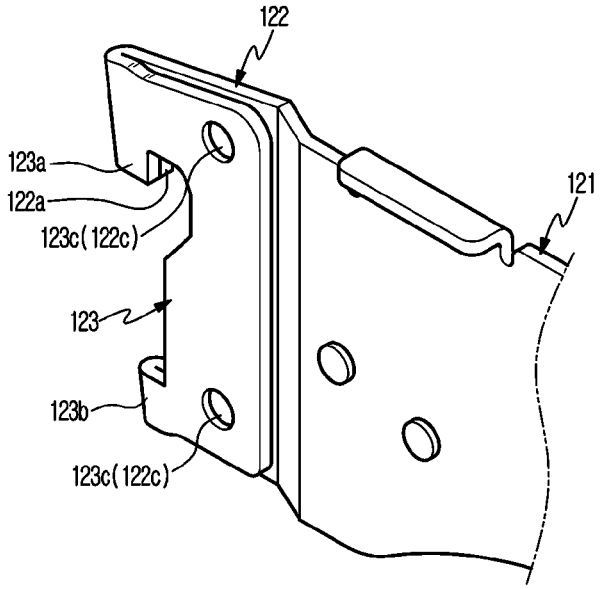
FIG. 4 is a perspective view of the mounting portion and the reinforcing portion of the shelf bracket applied to a refrigerator according to the first embodiment of the present disclosure, showing a state in which the reinforcing portion is folded.

As illustrated in FIGS. 2 and 3, the shelf bracket 12 includes a seating portion 121 on which the shelf 11 is seated, and a mounting portion 122 integrally extending from a rear end of the seating portion 121 and mounted to the shelf mounting guide 13. The shelf brackets 12 are provided as a pair of the shelf brackets 12 to correspond to opposite side ends of the shelf 11. The pair of shelf brackets 12 are disposed to be spaced apart from each other in the right-left direction to correspond to the opposite side ends of the shelf 11 to support the opposite side ends of the shelf 11.

The seating portions 121 extend in the front-rear direction such that the opposite side ends of the shelf 11 are seated on upper ends of the seating portions 121.

The mounting portion 122 includes a hooking portion 122*a* protruding downward from a rear upper portion thereof, and an insertion portion 122*b* protruding rearward from a rear lower portion thereof.

The shelf mounting guide 13 extends in the up-down direction, and two of the shelf mounting guides are disposed to be spaced apart from each other in the right-left direction to correspond to two of the shelf brackets 12 disposed to be spaced apart from each other.

The shelf mounting guide 12 is provided with a mounting hole 13*a* on which the mounting portion 122 of the shelf bracket 12 is mounted. A plurality of the mounting holes 13*a* is formed on the shelf mounting guide 12 in the up-down direction to adjust a mounting position of the shelf bracket 12 the up-down direction.

The hooking portion 122*a* of the shelf bracket 12 is caught and supported by the upper mounting hole 13*a* of two of the mounting holes 13*a* adjacent to each other in the up-down direction and the insertion portion 122*b* is inserted into the lower mounting hole 13*a* of two of the mounting holes, thereby preventing the left and right movement of the shelf bracket 12.

The shelf bracket 12 includes a reinforcing portion 123 to reinforce the strength of the mounting portion 122. The reinforcing portion 123 integrally extends from a rear end of the mounting portion 122 and is folded to overlap the mounting portion 122 to reinforce the strength of the mounting portion 122.

The reinforcing portion 123 includes a hooking reinforcing portion 123*a* formed in a shape symmetrical with the hooking portion 122*a* about the rear end of the mounting portion 122 as a center line (hereinafter referred to as line A-A), and an insertion reinforcing portion 123*b* formed in a shape symmetrical with the insertion portion 122*b* about the rear end of the mounting portion 122 as the center line A-A.

In addition, the mounting portion 122 includes coupling protrusions 122*c* protruding from one side surface thereof, and the reinforcing portion 123 includes coupling holes 123*c* to which the coupling protrusions 122*c* are coupled. The coupling protrusion 122*c* and the coupling hole 123*c* are provided at positions symmetrical with respect to the line A-A as the center line.

Thus, when the reinforcing portion 123*a* is folded about the line A-A as the center line, the hooking reinforcing portion 123*a* overlaps the hooking portion 122*a*, and the insertion reinforcing portion 123*b* overlaps the insertion portion 122*b*.

Therefore, the strength of the hooking portion 122*a* is reinforced by the hooking reinforcing portion 123*a* in contact with the side surface thereof, and the strength of the insertion portion 122*b* is reinforced by the insertion reinforcing portion 123*b* in contact with the side surface thereof.

Figure 5:
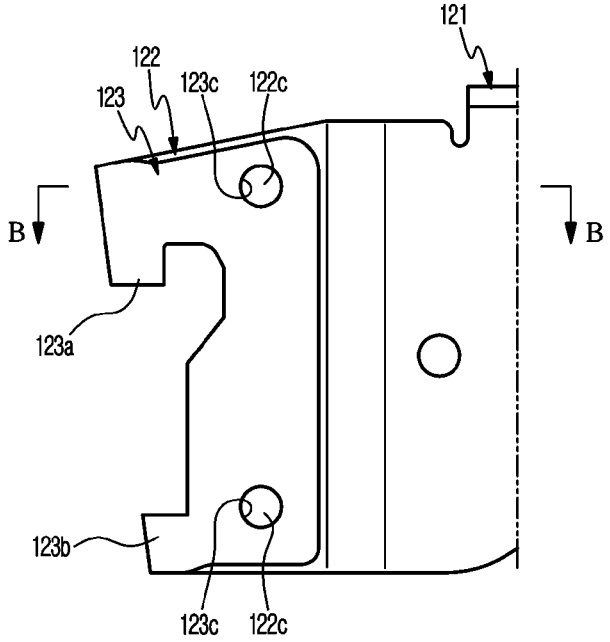
FIG. 5 is a side view of the mounting portion and the reinforcing portion of the shelf bracket applied to a refrigerator according to the first embodiment of the present disclosure, showing a state in which the reinforcing portion is folded.
Figure 6:
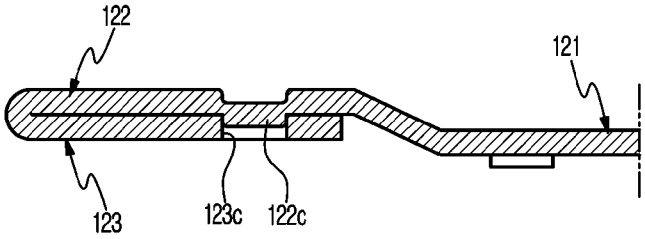
FIG. 6 is a cross-sectional view taken along line B-B of FIG. 5.

In addition, as described above, as illustrated in FIGS. 5 and 6, the coupling protrusion 122*c* is coupled to the coupling hole 123*c* in a process in which the reinforcing portion 123 is folded to overlap the mounting portion 122, so that the reinforcing portion 123 is fixed to the mounting portion 122.

Therefore, a welding operation and the like for fixing the reinforcing portion 123 to the mounting portion 122 may be omitted, so that the reinforcing portion 122 can be more easily reinforced.

In addition, because the reinforcing portion 123 and the mounting portion 122 are integrally formed and connected to each other, an excellent reinforcing effect may be obtained compared to a case where the reinforcing portion 123 is formed separately.

The present disclosure illustrates that the reinforcing portion 123 extends from the rear end of the mounting portion 122, but is not limited thereto, and the reinforcing portion may extend from an upper end or a lower end of the mounting portion.

The present disclosure illustrates that the coupling protrusion 122*c* is provided on the mounting portion 122 and the coupling hole 123*c* is provided on the reinforcing portion 123, but on the contrary, the coupling protrusion may be provided on the reinforcing portion and the coupling hole may be provided on the mounting portion.

Hereinafter, a shelf bracket applied to a refrigerator according to a second embodiment of the present disclosure will be described.

Figure 7:
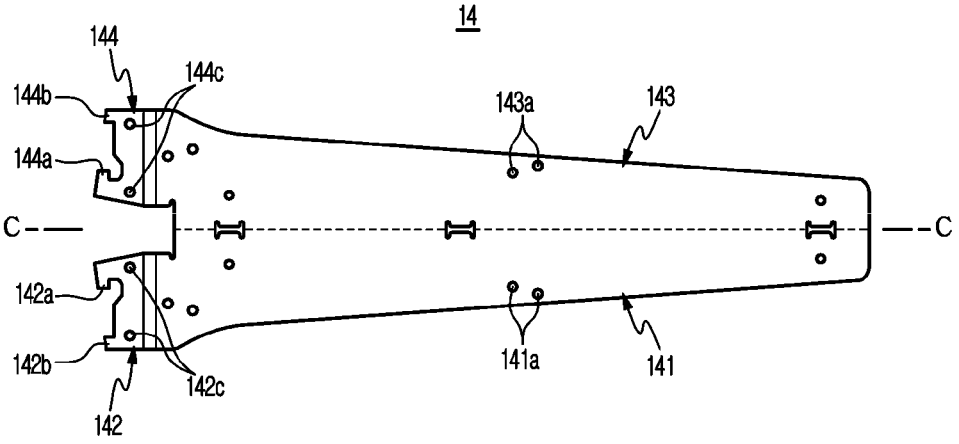
FIG. 7 is a view illustrating a shelf bracket applied to a refrigerator according to a second embodiment of the present disclosure.

As illustrated in FIG. 7, a shelf bracket 14 includes a seating portion 141 on which a shelf is seated, a mounting portion 142 provided on a rear side of the seating portion 141 and mounted on the shelf mounting guide 13 installed to the rear surfaces of the storage chambers 10*a* and 10*b*, and reinforcing portions 143 and 144 integrally extending from an upper end of the seating portion 141.

The reinforcing portions 143 and 144 are formed in a shape symmetrical with the seating portion 141 and the mounting portion 142 about an upper end of the seating portion 141 as a center line (line C-C). The reinforcing portions 143 and 144 include the seating reinforcing portion 143 formed in a shape symmetrical with the seating portion 141 and the mounting reinforcing portion 144 formed in a shape symmetrical with the reinforcing portion 143.

The mounting portion 142 includes a hooking portion 142*a* extending downward from a rear upper portion thereof and an insertion portion 142*b* protruding rearward from a rear lower portion thereof.

The mounting reinforcing portion 144 includes a hooking reinforcing portion 144*a* formed in a shape symmetrical with the hooking portion 142*a* and a insertion reinforcing portion 144*b* formed in a shape symmetrical with the insertion portion 142*b*.

The seating portion 141 and the mounting portion 142 include coupling protrusions 141*a* and 142*c* protruding from side surfaces thereof, respectively, and the reinforcing portions 143 and 144 include coupling holes 143*a* and 144*c* provided at positions symmetrical with the coupling protrusions 141*a* and 142*c*, respectively.

Thus, when the reinforcing portions 143 and 144 are folded about the line C-C as the center line, the coupling protrusions 141*a* and 142*c* are coupled to the coupling holes 143*a* and 144*c*, respectively. Therefore, the seating reinforcing portion 143 is coupled to a side surface of the seating portion 141 to reinforce the strength of the seating portion 141, and the mounting reinforcing portion 144 is coupled to a side surface of the mounting portion 142 to reinforce the strength of the mounting portion 142. In addition, because the mounting portion 142 includes the hooking portion 142*a* and the insertion portion 142*b*, the strength of the hooking portion 142*a* is reinforced by the hooking reinforcing portion 144*a*, and the strength of the insertion portion 142*b* is reinforced by the insertion reinforcing portion 144*b*.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body providing a storage chamber;

a shelf configured to partition the storage chamber in an up-down direction; and a shelf bracket configured to support the shelf, and comprising:

a seating portion on which the shelf is seated, a mounting portion mounted to the storage chamber, a reinforcing portion integrally extending from the mounting portion, a coupling protrusion on one of the mounting portion and the reinforcing portion, and a coupling hole on the other of the mounting portion and the reinforcing portion to which the coupling protrusion is coupleable, wherein the reinforcing portion is folded at a folding line from the mounting portion to overlap the mounting portion, and the coupling protrusion and the coupling hole are provided at positions symmetrical with respect to the folding line, so that the reinforcing portion overlaps symmetrically with the mounting portion when the coupling protrusion is coupled to the coupling hole.

2. The refrigerator according to claim 1, wherein the reinforcing portion integrally extends from a rear end of the mounting portion.

3. The refrigerator according to claim 2, wherein the mounting portion comprises a hooking portion protruding downward from a rear upper portion of the mounting portion, and the reinforcing portion comprises a hooking reinforcing portion formed in a shape symmetrical with the hooking portion about the rear end of the mounting portion as a center line.

4. The refrigerator according to claim 3, wherein the mounting portion comprises an insertion portion protruding rearward from a rear lower portion of the mounting portion, and the reinforcing portion comprises an insertion reinforcing portion formed in a shape symmetrical with the insertion portion about the rear end of the mounting portion as the center line.

5. The refrigerator according to claim 4, further comprising a shelf mounting guide extending in the up-down direction, wherein the shelf mounting guide comprises a plurality of mounting holes formed in the up-down direction.

6. The refrigerator according to claim 1, wherein the shelf bracket is configured to support a first end of the shelf, and the refrigerator further comprises an additional shelf bracket configured to support a second end of the shelf that is opposite to the first end, the additional shelf bracket comprising:

a seating portion on which the shelf is seated, a mounting portion mounted to the storage chamber, a reinforcing portion integrally extending from the mounting portion of the additional shelf bracket, a coupling protrusion on one of the mounting portion of the additional shelf bracket and the reinforcing portion of the additional shelf bracket, and a coupling hole on the other of the mounting portion of the additional shelf bracket and the reinforcing portion of the additional shelf bracket, wherein the reinforcing portion of the additional shelf bracket is folded to overlap the mounting portion of the additional shelf bracket and so that the coupling protrusion of the additional shelf bracket is coupled to the coupling hole of the additional shelf bracket.

7. A refrigerator comprising:

a main body providing a storage chamber;

a shelf configured to partition the storage chamber in an up-down direction; and a shelf bracket configured to support the shelf, and comprising:

a seating portion on which the shelf is seated, a mounting portion mounted to the storage chamber, a reinforcing portion integrally extending from an upper end of the seating portion, a coupling protrusion on one of the seating portion and the reinforcing portion, and a coupling hole on the other of the seating portion and the reinforcing portion to which the coupling protrusion is coupleable, wherein the reinforcing portion is folded at a folding line from the seating portion to overlap the seating portion, and the coupling protrusion and the coupling hole are provided at positions symmetrical with respect to the folding line, so that the reinforcing portion overlaps symmetrically with the seating portion when the coupling protrusion is coupled to the coupling hole.

8. A refrigerator comprising:

a main body providing a storage chamber;

a shelf configured to partition the storage chamber in an up-down direction; and a shelf bracket configured to support the shelf, and comprising:

a seating portion on which the shelf is seated, a mounting portion mounted to the storage chamber, first and second reinforcing portions integrally extending from an upper end of the seating portion, a first coupling protrusion on one of the mounting portion and the first reinforcing portion, a first coupling hole on the other of the mounting portion and the first reinforcing portion to which the first coupling protrusion is coupleable, a second coupling protrusion on one of the seating portion and the second reinforcing portion, and a second coupling hole on the other of the seating portion and the second reinforcing portion to which the second coupling protrusion is coupleable, wherein the first and second reinforcing portions are folded at a folding line from the seating portion to overlap the mounting portion and the seating portion, respectively, wherein the first coupling protrusion and the first coupling hole are provided at positions symmetrical with respect to the folding line so that the first reinforcing portion overlaps symmetrically with the mounting portion when the first coupling protrusion is coupled to the first coupling hole, and wherein the second coupling protrusion and the second coupling hole are provided at positions symmetrical with respect to the folding line so that the second reinforcing portion overlaps symmetrically with the seating portion when the second coupling protrusion is coupled to the second coupling hole.

* * * * *